US006250105B1

(12) United States Patent
Kimble

(10) Patent No.: US 6,250,105 B1
(45) Date of Patent: Jun. 26, 2001

(54) DUAL MULTI-COMPONENT REFRIGERATION CYCLES FOR LIQUEFACTION OF NATURAL GAS

(75) Inventor: E. Lawrence Kimble, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/464,157

(22) Filed: Dec. 16, 1999

Related U.S. Application Data

(60) Provisional application No. 60/112,801, filed on Dec. 18, 1998.

(51) Int. Cl.[7] ..... F25J 1/00
(52) U.S. Cl. ..... 62/613
(58) Field of Search ..... 62/611, 612, 613, 62/335

(56) References Cited

U.S. PATENT DOCUMENTS

| | | | |
|---|---|---|---|
| 2,731,810 | 1/1956 | Hachmuth | 62/132 |
| 3,593,535 | 7/1971 | Gaumer, Jr. et al. | 62/23 |
| 3,747,359 | 7/1973 | Streich | 62/24 |
| 3,964,891 | 6/1976 | Krieger | 62/9 |
| 3,970,441 | 7/1976 | Etzbach et al. | 62/28 |
| 4,112,700 | 9/1978 | Forg | 62/28 |
| 4,274,849 | 6/1981 | Garier et al. | 62/9 |
| 4,303,427 | 12/1981 | Krieger | 62/9 |
| 4,339,253 | 7/1982 | Caetani et al. | 62/40 |
| 4,504,296 | 3/1985 | Newton et al. | 62/31 |
| 4,525,185 | 6/1985 | Newton | 62/11 |
| 4,539,028 | 9/1985 | Paradowski et al. | 62/9 |
| 4,545,795 | 10/1985 | Liu et al. | 62/11 |
| 4,755,200 | 7/1988 | Liu et al. | 62/11 |
| 4,901,533 | 2/1990 | Fan et al. | 62/11 |
| 4,911,741 | 3/1990 | Davis et al. | 62/40 |
| 5,036,671 | 8/1991 | Nelson et al. | 62/23 |
| 5,161,382 | 11/1992 | Missimer | 62/46.1 |
| 5,363,655 | 11/1994 | Kikkawa et al. | 62/9 |
| 5,379,597 | 1/1995 | Howard et al. | 62/23 |
| 5,502,972 | 4/1996 | Howard et al. | 62/23 |
| 5,535,594 | 7/1996 | Grenier | 62/612 |
| 5,613,373 | 3/1997 | Grenier | 62/612 |
| 5,813,250 | 9/1998 | Ueno et al. | 62/612 |
| 5,950,453 | 9/1999 | Bowen et al. | 62/612 |

*Primary Examiner*—William Doerrler
*Assistant Examiner*—Malik N. Drake
(74) *Attorney, Agent, or Firm*—Gary Lawson

(57) ABSTRACT

A process is disclosed for liquefying natural gas to produce a pressurized liquid product having a temperature above −112° C. using two mixed refrigerants in two closed cycles, a low-level refrigerant to cool and liquefy the natural gas and a high-level refrigerant to cool the low-level refrigerant. After being used to liquefy the natural gas, the low-level refrigerant is (a) warmed by heat exchange in countercurrent relationship with another stream of the low-level refrigerant and by heat exchange against a first stream of the high-level refrigerant, (b) compressed to an elevated pressure, and (c) aftercooled against an external cooling fluid. The low-level refrigerant is then cooled by heat exchange against a second stream of the high-level mixed refrigerant and by exchange against the low-level refrigerant. The high-level refrigerant is warmed by the heat exchange with the low-level refrigerant, compressed to an elevated pressure, and aftercooled against an external cooling fluid.

6 Claims, 1 Drawing Sheet

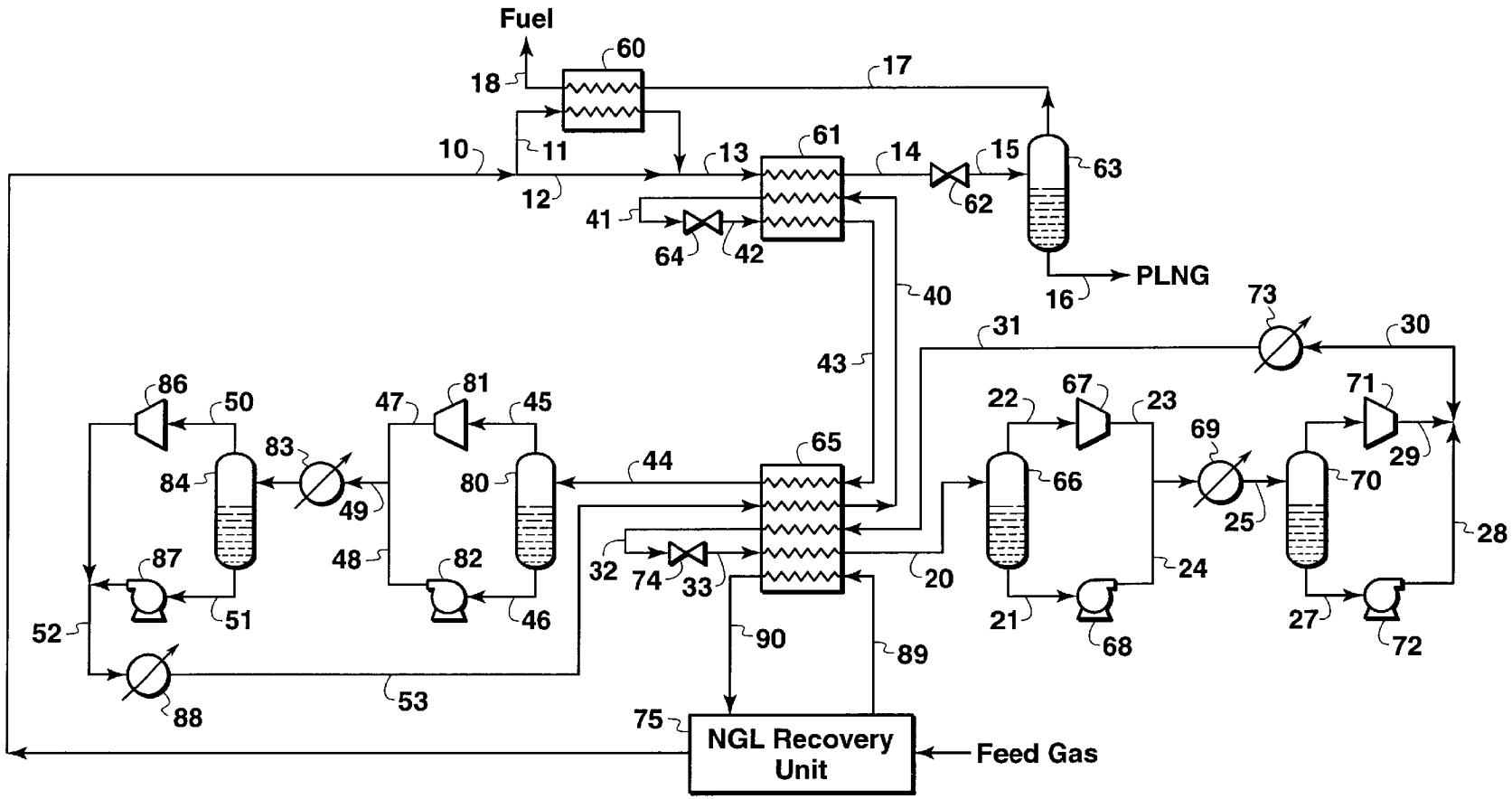
Fuel
PLNG
Feed Gas
NGL Recovery Unit

DUAL MULTI-COMPONENT REFRIGERATION CYCLES FOR LIQUEFACTION OF NATURAL GAS

This application claims the benefit of U.S. Provisional Application No. 60/112,801, filed Dec. 18, 1998.

FIELD OF THE INVENTION

This invention relates to a process for liquefaction of natural gas or other methane-rich gas streams. The invention is more specifically directed to a dual multi-component refrigerant liquefaction process to produce a pressurized liquefied natural gas having a temperature above −112° C. (−170° F.).

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

One of the distinguishing features of a LNG plant is the large capital investment required for the plant. The equipment used to liquefy natural gas is generally quite expensive. The liquefaction plant is made up of several basic systems, including gas treatment to remove impurities, liquefaction, refrigeration, power facilities, and storage and ship loading facilities. The plant's refrigeration systems can account for up to 30 percent of the cost.

LNG refrigeration systems are expensive because so much refrigeration is needed to liquefy natural gas. A typical natural gas stream enters a LNG plant at pressures from about 4,830 kPa (700 psia) to about 7,600 kPa (1,100 psia) and temperatures from about 20° C. (68° F.) to about 40° C. (104° F.). Natural gas, which is predominantly methane, cannot be liquefied by simply increasing the pressure, as is the case with heavier hydrocarbons used for energy purposes. The critical temperature of methane is −82.5° C. (−116.5° F.). This means that methane can only be liquefied below that temperature regardless of the pressure applied. Since natural gas is a mixture of gases, it liquefies over a range of temperatures. The critical temperature of natural gas is typically between about −85° C. (−121° F.) and −62° C. (−80° F.). Natural gas compositions at atmospheric pressure will typically liquefy in the temperature range between about −165° C. (−265° F.) and −155° C. (−247° F.). Since refrigeration equipment represents such a significant part of the LNG facility cost, considerable effort has been made to reduce refrigeration costs.

Although many refrigeration cycles have been used to liquefy natural gas, the three types most commonly used in LNG plants today are: (1) "cascade cycle" which uses multiple single component refrigerants in heat exchangers arranged progressively to reduce the temperature of the gas to a liquefaction temperature, (2) "expander cycle" which expands gas from a high pressure to a low pressure with a corresponding reduction in temperature, and (3) "multi-component refrigeration cycle" which uses a multi-component refrigerant in specially designed exchangers. Most natural gas liquefaction cycles use variations or combinations of these three basic types.

A multi-component refrigerant system involves the circulation of a multi-component refrigeration stream, usually after precooling to about −35° C. (−31° F.) with propane. A typical multi-component system will comprise methane, ethane, propane, and optionally other light components. Without propane precooling, heavier components such as butanes and pentanes may be included in the multi-component refrigerant. The nature of the multi-component refrigerant cycle is such that the heat exchangers in the process must routinely handle the flow of a two-phase refrigerant. Multi-component refrigerants exhibit the desirable property of condensing over a range of temperatures, which allows the design of heat exchange systems that can be thermodynamically more efficient than pure component refrigerant systems.

One proposal for reducing refrigeration costs is to transport liquefied natural gas at temperatures above −112° C. (−170° F.) and at pressures sufficient for the liquid to be at or below its bubble point temperature. For most natural gas compositions, the pressure of the PLNG ranges between about 1,380 kPa (200 psia) and about 4,500 kPa (650 psia). This pressurized liquid natural gas is referred to as PLNG to distinguish it from LNG which is at or near atmospheric pressure and at a temperature of about −160° C. PLNG requires significantly less refrigeration since PLNG can be more than 50° C. warmer than conventional LNG at atmospheric pressure.

A need exists for an improved closed-cycle refrigeration system using a multi-component refrigerant for liquefaction of natural gas to produce PLNG.

SUMMARY

This invention relates to a process for liquefying a natural gas stream to produce pressurized liquid product having a temperature above −112° C. (−170° F.) and a pressure sufficient for the liquid product to be at or below its bubble point using two closed-cycle, mixed (or multi-component) refrigerants wherein a high-level refrigerant cools a low-level refrigerant and the low-level refrigerant cools and liquefies the natural gas. The natural gas is cooled and liquefied by indirect heat exchange with the low-level multi-component refrigerant in a first closed refrigeration cycle. The low-level refrigerant is then warmed by heat exchange in countercurrent relationship with another stream of the low-level refrigerant and by heat exchange against a stream of the high-level refrigerant. The warmed low-level refrigerant is then compressed to an elevated pressure and aftercooled against an external cooling fluid. The low-level refrigerant is then cooled by heat exchange against a second stream of the high-level multi-component refrigerant and by exchange against the low-level refrigerant. The high-level refrigerant is warmed by the heat exchange with the low-level refrigerant. The warmed high-level refrigerant is compressed to an elevated pressure and aftercooled against an external cooling fluid.

An advantage of this refrigeration process is that the compositions of the two mixed refrigerants can be easily tailored (optimized) with each other and with the composition, temperature, and pressure of the stream being liquefied to minimize the total energy requirements for the process. The refrigeration requirements for a conventional unit to recover natural gas liquids (a NGL recovery unit) upstream of the liquefaction process can be integrated into the liquefaction process, thereby eliminating the need for a separate refrigeration system.

The process of this invention can also produce a source of fuel at a pressure that is suitable for fueling gas turbine drivers without further compression. For feed streams containing $N_2$, the refrigerant flow can be optimized to maximize the $N_2$ rejection to the fuel stream.

This process can reduce the total compression required by as much as 50% over conventional LNG liquefaction processes. This is advantageous since it allows more natural gas to be liquefied for product delivery and less consumed as fuel to power turbines used in compressors used in the liquefaction process.

BRIEF DESCRIPTION OF THE DRAWING

The present invention and its advantages will be better understood by referring to the following detailed description and the attached drawing, which is a simplified flow diagram of one embodiment of this invention illustrating a liquefaction process in accordance with the practice of this invention. This flow diagram presents a preferred embodiment of practicing the process of this invention. The drawing is not intended to exclude from the scope of the invention other embodiments that are the result of normal and expected modifications of this specific embodiment. Various required subsystems such as valves, flow stream mixers, control systems, and sensors have been deleted from the drawing for the purposes of simplicity and clarity of presentation.

DESCRIPTION OF THE PREFERRED EMBODIMENT

This invention relates to an improved process for manufacturing liquefied natural gas using two closed refrigeration cycles, both of which use multi-component or mixed refrigerants as a cooling medium. A low-level refrigerant cycle provides the lowest temperature level of refrigerant for the liquefaction of the natural gas. The low-level (lowest temperature) refrigerant is in turn cooled by a high-level (relatively warmer) refrigerant in a separate heat exchange cycle.

The process of this invention is particularly useful in manufacturing pressurized liquid natural gas (PLNG) having a temperature above −112° C. (−170° F.) and a pressure sufficient for the liquid product to be at or below its bubble point temperature. The term "bubble point" means the temperature and pressure at which the liquid begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point. At the bubble point, the liquefied gas is saturated liquid. For most natural gas compositions, the pressure of PLNG at temperatures above −112° C. will be between about 1,380 kPa (200 psia) and about 4,500 kPa (650 psia).

Referring to the drawing, a natural gas feed stream is preferably first passed through a conventional natural gas recovery unit 75 (a NGL recovery unit). If the natural gas stream contains heavy hydrocarbons that could freeze out during liquefaction or if the heavy hydrocarbons, such as ethane, butane, pentane, hexanes, and the like, are not desired in PLNG, the heavy hydrocarbon may be removed by a natural gas NGL recovery unit prior to liquefaction of the natural gas. The NGL recovery unit 75 preferably comprises multiple fractionation columns (not shown) such as a deethanizer column that produces ethane, a depropanizer column that produces propane, and a debutanizer column that produces butane. The NGL recovery unit may also include systems to remove benzene. The general operation of a NGL recovery unit is well known to those skilled in the art. Heat exchanger 65 can optionally provide refrigeration duty to the NGL recovery unit 75 in addition to providing cooling of the low-level refrigerant as described in more detail below.

The natural gas feed stream may comprise gas obtained from a crude oil well (associated gas) or from a gas well (non-associated gas), or from both associated and non-associated gas sources. The composition of natural gas can vary significantly. As used herein, a natural gas stream contains methane ($C_1$) as a major component. The natural gas will typically also contain ethane ($C_2$), higher hydrocarbons ($C_{3+}$), and minor amounts of contaminants such as water, carbon dioxide, hydrogen sulfide, nitrogen, butane, hydrocarbons of six or more carbon atoms, dirt, iron sulfide, wax, and crude oil. The solubilities of these contaminants vary with temperature, pressure, and composition. At cryogenic temperatures, $CO_2$, water, and other contaminants can form solids, which can plug flow passages in cryogenic heat exchangers. These potential difficulties can be avoided by removing such contaminants if conditions within their pure component, solid phase temperature-pressure phase boundaries are anticipated. In the following description of the invention, it is assumed that the natural gas stream prior to entering the NGL recovery unit 75 has been suitably pretreated to remove sulfides and carbon dioxide and dried to remove water using conventional and well-known processes to produce a "sweet, dry" natural gas stream.

A feed stream 10 exiting the NGL recovery unit is split into streams 11 and 12. Stream 11 is passed through heat exchanger 60 which, as described below, heats a fuel stream 17 and cools feed stream 11. After exiting heat exchanger 60, feed stream 11 is recombined with stream 12 and the combined stream 13 is passed through heat exchanger 61 which at least partially liquefies the natural gas stream. The at least partially liquid stream 14 exiting heat exchanger 61 is optionally passed through one or more expansion means 62, such as a Joule-Thomson valve, or alternatively a hydraulic turbine, to produce PLNG at a temperature above about −112° C. (−170° F.). From the expansion means 62, an expanded fluid stream 15 is passed to a phase separator 63. A vapor stream 17 is withdrawn from the phase separator 63. The vapor stream 17 may be used as fuel to supply power that is needed to drive compressors and pumps used in the liquefaction process. Before being used as fuel, vapor stream 17 is preferably used as a refrigeration source to assist in cooling a portion of the feed stream in heat exchanger 60 as discussed above. A liquid stream 16 is discharged from separator 63 as PLNG product having a temperature above about −112° C. (−170° F.) and a pressure sufficient for the PLNG to be at or below its bubble point.

Refrigeration duty for heat exchanger 61 is provided by closed-loop cooling. The refrigerant in this cooling cycle uses what is referred to as a low-level refrigerant because it is a relatively low temperature mixed refrigerant compared to a higher temperature mixed refrigerant used in the cooling cycle that provides refrigeration duty for heat exchanger 65. Compressed low-level mixed refrigerant is passed through the heat exchanger 61 through flow line 40 and exits the heat exchanger 61 in line 41. The low-level mixed refrigerant is desirably cooled in the heat exchanger 61 to a temperature at which it is completely liquid as it passes from the heat exchanger 61 into flow line 41. The low-level mixed refrigerant in line 41 is passed through an expansion valve 64 where a sufficient amount of the liquid low-level mixed refrigerant is flashed to reduce the temperature of the low-level mixed refrigerant to a desired temperature. The desired temperature for making PLNG is typically from below about −85° C., and preferably between about −95° C. and −110° C. The pressure is reduced across the expansion valve 64. The low-level mixed refrigerant enters heat exchanger 61 through flow line 42 and it continues vaporizing as it proceeds through heat exchanger 61. The low-level mixed refrigerant is a gas/liquid mixture (predominantly gaseous) as it is discharged into line 43. The low-level mixed refrigerant is passed by line 43 through heat exchanger 65 where the low-level mixed refrigerant continues to be warmed and vaporized (1) by indirect heat exchange in countercurrent relationship with another stream (stream 53) of the low-level refrigerant and (2) by indirect heat exchange against stream 31 of the high-level refrigerant. The warmed low-level mixed refrigerant is passed by line 44 to a vapor-liquid separator 80 where the refrigerant is separated into a liquid portion and a gaseous portion. The gaseous portion is passed by line 45 to a compressor 81 and the liquid portion is passed by line 46 to a pump 82 where the liquid portion is pressurized. The compressed gaseous low-level mixed refrigerant in line 47 is combined with the pressurized liquid in line 48 and the combined low-level mixed refrigerant stream is cooled by after-cooler 83. After-cooler 83 cools the low-level mixed refrigerant by indirect heat exchange with an external cooling medium, preferably a cooling medium that ultimately uses the environment as a heat sink. Suitable environmental cooling mediums may include the atmosphere, fresh water, salt water, the earth, or two or more of the preceding. The cooled low-level mixed refrigerant is then passed to a second vapor-liquid separator 84 where it is separated into a liquid portion and a gaseous portion. The gaseous portion is passed by line 50 to a compressor 86 and the liquid portion is passed by line 51 to pump 87 where the liquid portion is pressurized. The compressed gaseous low-level mixed refrigerant is combined with the pressurized liquid low-level mixed refrigerant and the combined low-level mixed refrigerant (stream 52) is cooled by after-cooler 88 which is cooled by a suitable external cooling medium similar to after-cooler 83. After exiting after-cooler 88, the low-level mixed refrigerant is passed by line 53 to heat exchanger 65 where a substantial portion of any remaining vaporous low-level mixed refrigerant is liquefied by indirect heat exchange against low-level refrigerant stream 43 that passes through heat exchanger 65 and by indirect heat exchange against refrigerant of the high-level refrigeration (stream 31).

Referring to the high-level refrigeration cycle, a compressed, substantially liquid high-level mixed refrigerant is passed through line 31 through heat exchanger 65 to a discharge line 32. The high-level mixed refrigerant in line 31 is desirably cooled in the heat exchanger 65 to a temperature at which it is completely liquid before it passes from heat exchanger 65 into line 32. The refrigerant in line 32 is passed through an expansion valve 74 where a sufficient amount of the liquid high-level mixed refrigerant is flashed to reduce the temperature of the high-level mixed refrigerant to a desired temperature. The high-level mixed refrigerant (stream 33) boils as it passes through the heat exchanger 65 so that the high-level mixed refrigerant is essentially gaseous as it is discharged into line 20. The essentially gaseous high-level mixed refrigerant is passed by line 20 to a refrigerant vapor-liquid separator 66 where it is separated into a liquid portion and a gaseous portion. The gaseous portion is passed by line 22 to a compressor 67 and the liquid portion is passed by line 21 to pump 68 where the liquid portion is pressurized. The compressed gaseous high-level mixed refrigerant in line 23 is combined with the pressurized liquid in line 24 and the combined high-level mixed refrigerant stream is cooled by after-cooler 69. After-cooler 69 cools the high-level mixed refrigerant by indirect heat exchange with an external cooling medium, preferably a cooling medium that ultimately uses the environment as a heat sink, similar to after-coolers 83 and 88. The cooled high-level mixed refrigerant is then passed to a second vapor-liquid separator 70 where it is separated into a liquid portion and a gaseous portion. The gaseous portion is passed to a compressor 71 and the liquid portion is passed to pump 72 where the liquid portion is pressurized. The compressed gaseous high-level mixed refrigerant (stream 29) is combined with the pressurized liquid high-level mixed refrigerant (stream 28) and the combined high-level mixed refrigerant (stream 30) is cooled by after-cooler 73 which is cooled by a suitable external cooling medium. After exiting after-cooler 73, the high-level mixed refrigerant is passed by line 31 to heat exchanger 65 where the substantial portion of any remaining vaporous high-level mixed refrigerant is liquefied.

Heat exchangers 61 and 65 are not limited to any type, but because of economics, plate-fin, spiral wound, and cold box heat exchangers are preferred, which all cool by indirect heat exchange. The term "indirect heat exchange," as used in this description, means the bringing of two fluid streams into heat exchange relation without any physical contact or intermixing of the fluids with each other. The heat exchangers used in the practice of this invention are well known to those skilled in the art. Preferably all streams containing both liquid and vapor phases that are sent to heat exchangers 61 and 65 have both the liquid and vapor phases equally distributed across the cross section area of the passages they enter. To accomplish this, it is preferred to provide distribution apparati for individual vapor and liquid streams. Separators can be added to the multi-phase flow streams as required to divide the streams into liquid and vapor streams. For example, separators could be added to stream 42 immediately before stream 42 enters heat exchanger 61.

The low-level mixed refrigerant, which actually performs the cooling and liquefaction of the natural gas, may comprise a wide variety of compounds. Although any number of components may form the refrigerant mixture, the low-level mixed refrigerant preferably ranges from about 3 to about 7 components. For example, the refrigerants used in the refrigerant mixture may be selected from well-known halogenated hydrocarbons and their azeotrophic mixtures as well as various hydrocarbons. Some examples are methane, ethylene, ethane, propylene, propane, isobutane, butane, butylene, trichlormonofluoromethane, dichlorodifluoromethane, monochlorotrifluoromethane, monochlorodifluoroumethane, tetrafluoromethane, monochloropentafluoroethane, and any other hydrocarbon-based refrigerant known to those skilled in the art. Non-hydrocarbon refrigerants, such as nitrogen, argon, neon, helium, and carbon dioxide may also be used. The only criteria for components of the low-level refrigerant is that they be compatible and have different boiling points, preferably having a difference of at least about 10° C. (50° F.). The low-level mixed refrigerant must be capable of being in essentially a liquid state in line 41 and also capable of vaporizing by heat exchange against itself and the natural gas to be liquefied so that the low-level refrigerant is predominantly gaseous state in line 43. The low-level mixed refrigerant must not contain compounds that would solidify in heat exchangers 61 or 65. Examples of suitable low-level mixed refrigerants can be expected to fall within the following mole fraction percent ranges: $C_1$: about 15% to 30%, $C_2$: about 45% to 60%, $C_3$: about 5% to 15%, and $C_4$: about 3% to 7%. The concentration of the low-level mixed refrigerant components may be adjusted to match the cooling and condensing characteristics of the natural gas being liquefied and the cryogenic temperature requirements of the liquefaction process.

The high-level mixed refrigerant may also comprise a wide variety of compounds. Although any number of components may form the refrigerant mixture, the high-level mixed refrigerant preferably ranges from about 3 to about 7 components. For example, the high-level refrigerants used in the refrigerant mixture may be selected from well-known halogenated hydrocarbons and their azeotrophic mixtures, as well as, various hydrocarbons. Some examples are methane, ethylene, ethane, propylene, propane, isobutane, butane, butylene, trichlormonofluoromethane, dichlorodifluoromethane, monochlorotrifluoromethane, monochlorodifluoroumethane, tetrafluoromethane, monochloropentafluoroethane, and any other hydrocarbon-based refrigerant known to those skilled in the art. Non-hydrocarbon refrigerants, such as nitrogen, argon, neon, helium, and carbon dioxide may be used. The only criteria for the components of the high-level refrigerant is that they be compatible and have different boiling points, preferably having a difference of at least about 10° C. (50° F.). The high-level mixed refrigerant must be capable of being in substantially liquid state in line 32 and also capable of fully vaporizing by heat exchange against itself and the low-level refrigerant (stream 43) being warmed in heat exchanger 65 so that the high-level refrigerant is predominantly in a gaseous state in line 20. The high-level mixed refrigerant must not contain compounds that would solidify in heat exchanger 65. Examples of suitable high level mixed refrigerants can be expected to fall within the following mole fraction percent ranges: $C_1$: about 0% to 10%, $C_2$: 60% to 85%, $C_3$: about 2% to 8%, $C_4$: about 2% to 12%, and $C_5$: about 1% to 15%. The concentration of the high-level mixed refrigerant components may be adjusted to match the cooling and condensing characteristics of the natural gas being liquefied and the cryogenic temperature requirements of the liquefaction process.

EXAMPLE

A simulated mass and energy balance was carried out to illustrate the embodiment shown in the drawing, and the results are shown in the Table below. The data were obtained using a commercially available process simulation program called HYSYS™ (available from Hyprotech Ltd. of Calgary, Canada); however, other commercially available process simulation programs can be used to develop the data, including for example HYSIM™, PROII™, and ASPEN PLUS™, which are familiar to those of ordinary skill in the art. The data presented in the Table are offered to provide a better understanding of the embodiment shown in the drawing, but the invention is not to be construed as unnecessarily limited thereto. The temperatures and flow rates are not to be considered as limitations upon the invention which can have many variations in temperatures and flow rates in view of the teachings herein.

This example assumed the natural gas feed stream 10 had the following composition in mole percent: $C_1$: 94.3%; $C_2$: 3.9%; $C_3$: 0.3%; $C_4$: 1.1%; $C_5$: 0.4%. The composition of the low-level refrigerant to heat exchanger 61 in mole percent was: $C_1$: 33.3%; $C_2$: 48.3%; $C_3$: 2.1%; $C_4$: 2.9%; $C_5$: 13.4%. The composition ofthe high-level refrigerant to heat exchanger 65 in mole percent was: $C_1$: 11.5%; $C_2$: 43.9%; $C_3$: 32.1%; $C_4$: 1.6%; $C_5$: 10.9%. The compositions of the refrigerants in closed cycles can be tailored by those skilled in the art to minimize refrigeration energy requirements for a wide variety of feed gas compositions, pressures, and temperatures to liquefy the natural gas to produce PLNG.

The data in the table show that the maximum required refrigerant pressure in the low-level cycle does not exceed 2,480 kPa (360 psia). A conventional refrigeration cycle to liquefy natural gas to temperatures of about −160° C. typically requires refrigeration pressure of about 6,200 kPa (900 psia). By using a significantly lower pressure in the low-level refrigeration cycle, significantly less piping material is required for the refrigeration cycle.

Another advantage of the present invention as shown in this example is that the fuel stream 18 is provided at a pressure sufficient for use in conventional gas turbines during the liquefaction process without using auxiliary fuel gas compression.

A person skilled in the art, particularly one having the benefit of the teachings of this patent, will recognize many modifications and variations to the specific embodiment disclosed above. For example, a variety of temperatures and pressures may be used in accordance with the invention, depending on the overall design of the system and the composition of the feed gas. Also, the feed gas cooling train may be supplemented or reconfigured depending on the overall design requirements to achieve optimum and efficient heat exchange requirements. Additionally, certain process steps may be accomplished by adding devices that are interchangeable with the devices shown. As discussed above, the specifically disclosed embodiment and example should not be used to limit or restrict the scope of the invention, which is to be determined by the claims below and their equivalents.

TABLE

| | | Temperature | | Pressure | | Flowrate | | Composition | | | | |
|---|---|---|---|---|---|---|---|---|---|---|---|---|
| | | | | | | | | $C_1$ | $C_2$ | $C_3$ | $C_4$ | $C_5$ |
| Stream | Phase | Deg C. | Deg F. | kpa | Psia | KgMol/hr | lbmol/hr | Mol % | Mol % | Mol % | Mol % | Mol % |
| 10 | Vap | −42.2 | −44.6 | 4800 | 696 | 47,673 | 105,100 | 94.3 | 3.9 | 0.3 | 1.1 | 0.4 |
| 11 | Vap | −42.2 | −44.6 | 4758 | 690 | 1,906 | 4,203 | 94.3 | 3.9 | 0.3 | 1.1 | 0.4 |
| 12 | Vap | −42.2 | −44.6 | 4758 | 690 | 45,768 | 100,900 | 94.3 | 3.9 | 0.3 | 1.1 | 0.4 |
| 13 | Vap/liq | −43.3 | −46.5 | 4775 | 693 | 47,673 | 105,100 | 94.3 | 3.9 | 0.3 | 1.1 | 0.4 |
| 14 | Liq | −93.4 | −136.7 | 4569 | 663 | 47,673 | 105,100 | 94.3 | 3.9 | 0.3 | 1.1 | 0.4 |
| 15 | Vap/liq | −95.8 | −141.1 | 2758 | 400 | 47,673 | 105,100 | 94.3 | 3.9 | 0.3 | 1.1 | 0.4 |
| 16 | Liq | −95.8 | −141.1 | 2758 | 400 | 46,539 | 102,600 | 94.1 | 4.0 | 0.3 | 1.1 | 0.5 |
| 17 | Vap | −95.8 | −141.1 | 2758 | 400 | 1,134 | 2,500 | 99.4 | 0.5 | 0.0 | 0.0 | 0.0 |

TABLE-continued

| | | Temperature | | Pressure | | Flowrate | | Composition | | | | |
|---|---|---|---|---|---|---|---|---|---|---|---|---|
| | | | | | | | | $C_1$ | $C_2$ | $C_3$ | $C_4$ | $C_5$ |
| Stream | Phase | Deg C. | Deg F. | kpa | Psia | KgMol/hr | lbmol/hr | Mol % | Mol % | Mol % | Mol % | Mol % |
| 18 | Vap | −45.2 | −50.0 | 2738 | 397 | 1,134 | 2,500 | 99.4 | 0.5 | 0.0 | 0.0 | 0.0 |
| 20 | Vap/liq | 9.1 | 47.8 | 345 | 50 | 17,609 | 38,820 | 11.5 | 43.7 | 32.0 | 1.6 | 11.2 |
| 21 | Liq | 9.1 | 47.8 | 345 | 50 | 102 | 225 | 0.3 | 6.5 | 18.7 | 2.7 | 71.8 |
| 22 | Vap | 9.1 | 47.8 | 345 | 50 | 17,504 | 38,590 | 11.5 | 43.9 | 32.1 | 1.6 | 10.9 |
| 23 | Vap | 62.8 | 144.4 | 1034 | 150 | 17,504 | 38,590 | 11.5 | 43.9 | 32.1 | 1.6 | 10.9 |
| 24 | Liq | 9.5 | 48.5 | 1069 | 155 | 102 | 225 | 0.3 | 6.5 | 18.7 | 2.7 | 71.8 |
| 25 | Vap/liq | 13.1 | 55.0 | 986 | 143 | 17,609 | 38,820 | 11.5 | 43.7 | 32.0 | 1.6 | 11.2 |
| 26 | Vap | 13.1 | 55.0 | 986 | 143 | 13,236 | 29,180 | 14.9 | 51.7 | 29.5 | 0.9 | 3.0 |
| 27 | Liq | 13.1 | 55.0 | 986 | 143 | 4,370 | 9,635 | 1.0 | 19.6 | 39.8 | 3.3 | 36.3 |
| 28 | Liq | 14.2 | 57.0 | 2462 | 357 | 4,370 | 9,635 | 1.0 | 19.6 | 39.8 | 3.3 | 36.3 |
| 29 | Vap | 66.2 | 150.6 | 2462 | 357 | 13,236 | 29,180 | 14.9 | 51.7 | 29.5 | 0.9 | 3.0 |
| 30 | Vap/liq | 47.7 | 117.2 | 2462 | 357 | 17,609 | 38,820 | 11.5 | 43.9 | 32.1 | 1.6 | 10.9 |
| 32 | Liq | −48.0 | −55.0 | 2345 | 340 | 17,609 | 38,820 | 11.5 | 43.9 | 32.1 | 1.6 | 10.9 |
| 33 | Vap/liq | −64.2 | −84.1 | 365 | 53 | 17,609 | 38,820 | 11.5 | 43.9 | 32.1 | 1.6 | 10.9 |
| 40 | Vap/liq | −48.0 | −55.0 | 2345 | 340 | 50,894 | 112,200 | 33.3 | 48.3 | 2.1 | 2.9 | 13.4 |
| 41 | Liq | −93.4 | −136.7 | 2138 | 310 | 50,894 | 112,200 | 33.3 | 48.3 | 2.1 | 2.9 | 13.4 |
| 42 | Vap/liq | −111.2 | −168.8 | 386 | 56 | 50,894 | 112,200 | 33.3 | 48.3 | 2.1 | 2.9 | 13.4 |
| 43 | Vap/liq | −47.8 | −54.7 | 365 | 53 | 50,894 | 112,200 | 33.3 | 48.3 | 2.1 | 2.9 | 13.4 |
| 44 | Vap/liq | 9.1 | 47.8 | 345 | 50 | 50,894 | 112,200 | 33.3 | 48.3 | 2.1 | 2.9 | 13.4 |
| 45 | Vap | 9.1 | 47.8 | 345 | 50 | 50,486 | 111,300 | 33.6 | 48.7 | 2.1 | 2.8 | 12.8 |
| 46 | Liq | 9.1 | 47.8 | 345 | 50 | 441 | 972 | 0.7 | 7.0 | 1.2 | 5.1 | 85.8 |
| 47 | Vap | 86.1 | 186.4 | 1379 | 200 | 50,486 | 111,300 | 33.6 | 48.7 | 2.1 | 2.8 | 12.8 |
| 48 | Liq | 9.7 | 48.8 | 1379 | 200 | 441 | 972 | 0.7 | 7.0 | 1.2 | 5.1 | 85.8 |
| 49 | Vap/liq | 82.1 | 179.2 | 1379 | 200 | 50,894 | 112,200 | 33.3 | 48.3 | 2.1 | 2.9 | 13.4 |
| 50 | Vap | 13.1 | 55.0 | 1331 | 193 | 42,108 | 92,830 | 39.5 | 53.0 | 1.9 | 1.8 | 3.8 |
| 51 | Liq | 13.1 | 55.0 | 1331 | 193 | 8,800 | 19,400 | 3.5 | 25.5 | 3.2 | 8.3 | 59.5 |
| 52 | Vap/liq | 36.6 | 97.3 | 2462 | 357 | 50,894 | 112,200 | 33.3 | 48.3 | 2.1 | 2.9 | 13.4 |
| 53 | Vap/lig | 13.1 | 55.0 | 2414 | 350 | 50,894 | 112,200 | 33.3 | 48.3 | 2.1 | 2.9 | 13.4 |
| 89 | Vap/liq | 7.0 | 44.0 | 5400 | 783 | 48,036 | 105,900 | 93.5 | 3.9 | 0.3 | 0.7 | 1.6 |
| 90 | Vap/liq | −48.0 | −55.0 | 5365 | 778 | 48,036 | 105,900 | 93.5 | 3.9 | 0.3 | 0.7 | 1.6 |

What is claimed is:

1. A process for liquefying a natural gas stream to produce pressurized liquid product having a temperature above −112° C. (−170° F.) and a pressure sufficient for the liquid product to be at or below its bubble point using two closed cycle, multi-component refrigerants wherein a high-level refrigerant cools a low-level refrigerant and the low-level refrigerant cools and liquefies the natural gas, comprising the steps of:

(a) cooling and liquefying a natural gas stream by indirect heat exchange with a low-level multi-component refrigerant in a first closed refrigeration cycle, (b) warming the low-level refrigerant by heat exchange in countercurrent relationship with another stream of the low-level refrigerant and by heat exchange against a stream of the high-level refrigerant;

(c) compressing said warmed low-level refrigerant of step (b) to an elevated pressure and aftercooling it against an external cooling fluid;

(d) further cooling said low-level refrigerant by heat exchange against a second stream of the high-level multi-component and against the low-level refrigerant of step (b), said high-level refrigerant being warmed during the heat exchange; and (e) compressing said warmed high-level refrigerant of step (d) to an elevated pressure and aftercooling it against an external cooling fluid.

2. The process of claim 1 wherein the indirect heat exchange of step (a) consists of one stage.

3. The process of claim 1 wherein the low-level multi-component refrigerant comprises methane, ethane, butane and pentane.

4. The process of claim 1 wherein the high-level multi-component refrigerant comprises butane and pentane.

5. A process for liquefying a methane-rich gas stream to produce pressurized liquid product having a temperature above −112° C. (−170° F.) and a pressure sufficient for the liquid product to be at or below its bubble point using two closed, multi-component refrigeration cycles, each refrigerant in said refrigeration cycles comprising constituents of various volatilities, comprising (a) liquefying the methane-rich gas stream in a first heat exchanger against a first low-level mixed refrigerant which circulates in a first refrigeration cycle;

(b) compressing the first low-level mixed refrigerant in a plurality of compression stages and cooling the compressed low-level mixed refrigerant in one or more stages against an external cooling fluid;

(c) cooling the compressed, cooled first low-level mixed refrigerant against a second low-level mixed refrigerant in a second heat exchanger to at least partially liquefy the compressed first low-level mixed refrigerant before liquefying the methane-rich gas in the first heat exchanger; and (d) compressing the second multi-component refrigerant in a plurality of compression stages and cooling the compressed second multi-component refrigerant in one or more stages against an external cooling fluid, heat exchanging the compressed, cooled, second multi-component refrigerant in the second heat exchanger to produce a cooled, at least partially liquid second multi-component refrigerant, expanding the cooled, at least partially liquid second multi-component refrigerant to produce a low temperature coolant and passing the low temperature coolant in countercurrent heat exchange with the compressed, cooled, second multi-component refrigerant to at least partially liquefy the first multi-component refrigerant and to at least partially vaporize the second multi-component refrigerant, and recycling the second multi-component refrigerant to the first stage of compression.

6. A process for liquefaction of a gas rich in methane to produce a pressurized liquid product having a temperature above about −112° C., comprising the steps of:

(a) cooling and liquefying the gas in a first heat exchanger by heat exchange against a first multi-component refrigerant of a first closed refrigeration cycle;

(b) cooling said first multi-component refrigerant in a second heat exchanger against a second multi-component refrigerant in a second closed refrigeration cycle;

(c) said first refrigeration cycle comprising pressurizing and cooling the cooled first refrigerant of step (b) in at least one stage of compression and cooling which comprises phase separating the warmed first refrigerant into a vapor phase and a liquid phase, separately pressurizing the vapor phase and the liquid phase, combining the pressurized liquid phase and pressurized vapor phase, and aftercooling the combined phases against an external cooling fluid;

passing the pressurized first refrigerant through the second heat exchanger to cool the first refrigerant against the second refrigerant;

passing the pressurized first refrigerant through the first exchanger;

expanding the pressurized first refrigerant to convert the first refrigerant into a lower temperature mixed refrigerant and passing the expanded first refrigerant through the first heat exchanger in counter-current relationship with itself before expansion and with gas rich in methane, thereby warming the expanded first refrigerant and producing a pressurized liquid having a temperature above about −112° C., and recycling the warmed, expanded first refrigerant to the second heat exchanger; and (d) said second refrigeration cycle comprising:

pressurizing and cooling the warmed second refrigerant in at least one stage of compression and cooling which comprises phase separating the warmed second refrigerant into a vapor phase and a liquid phase, separately pressurizing the vapor phase and the liquid phase, combining the pressurized liquid phase and pressurized vapor phase, and aftercooling the combined phases against an external cooling fluid;

passing the pressurized second refrigerant through the second heat exchanger to cool the first refrigerant against the second refrigerant;

expanding the pressurized second refrigerant to a lower temperature and passing the expanded second refrigerant through the second heat exchanger in counter-current relationship with itself before expansion and with the first refrigerant, thereby warming the expanded second refrigerant.

* * * * *